US005916489A

United States Patent [19]

Takeuchi

[11] Patent Number: 5,916,489

[45] Date of Patent: Jun. 29, 1999

[54] FLOAT FOR CARBURETORS

[75] Inventor: Youichi Takeuchi, Kawaguchi, Japan

[73] Assignee: Enplas Corporation, Kawaguchi, Japan

[21] Appl. No.: 08/819,103

[22] Filed: Mar. 19, 1997

[30] Foreign Application Priority Data

| | | | |
|---|---|---|---|
| Mar. 19, 1996 | [JP] | Japan | 8-063052 |
| Mar. 25, 1996 | [JP] | Japan | 8-068171 |
| Mar. 25, 1996 | [JP] | Japan | 8-068172 |

[51] Int. Cl.[6] ..... F02M 5/16

[52] U.S. Cl. ..... 261/70; 137/423; 137/434

[58] Field of Search ..... 261/70; 137/423, 137/434

[56] References Cited

U.S. PATENT DOCUMENTS

| | | | |
|---|---|---|---|
| 1,743,791 | 1/1930 | Mock | 261/70 |
| 1,933,360 | 10/1933 | Barbarou | 261/70 X |
| 3,142,310 | 7/1964 | Feldermann | 261/70 X |
| 3,263,975 | 8/1966 | Wu | 261/70 |
| 4,034,026 | 7/1977 | Miller | 261/70 X |
| 4,057,603 | 11/1977 | Irie | 261/70 |
| 4,464,312 | 8/1984 | Zaita | 261/70 |

FOREIGN PATENT DOCUMENTS

| | | | |
|---|---|---|---|
| 62-43059 | 9/1987 | Japan . | |
| 4-128542 | 4/1992 | Japan | 261/70 |
| 1526564 | 9/1978 | United Kingdom | 261/70 |
| 2042087 | 9/1980 | United Kingdom | 261/70 |

*Primary Examiner*—Richard L. Chiesa
*Attorney, Agent, or Firm*—Pillsbury Madison & Sutro LLP

[57] ABSTRACT

A float of synthetic resin for carburetors includes a base having a mounting portion for mounting the float in a float chamber; two float parts arranged opposite to each other, swinging in accordance with an amount of fuel in the float chamber; and an arm portion connected to the base at one place in its longitudinal direction, connecting the two float parts to its ends. The arm portion is configure so that a sectional area perpendicular to the longitudinal direction is small in a region surrounded by the two float parts and is larger in an opposite region. In this way, the arm portion is not deformed in the region surrounded by the two float parts in the cooling process of molding fabrication, and a float for carburetors of predetermined shape can be manufactured at low cost.

12 Claims, 10 Drawing Sheets

FLOAT FOR CARBURETORS

BACKGROUND OF THE INVENTION

1. Field of the Invention

This invention relates to a float of synthetic resin for a carburetor which is used to supply fuel to an engine of a vehicle, and in particular, to a float usually called a double float which has two float parts.

2. Description of Related Art

In recent years, according to the need for compactness of the carburetor, a float chamber has been designed to have the smallest possible size. Thus, in most cases, a partition wall between the float chamber and a suction tube assumes a special shape, and a jet nozzle for fuel is located in the vicinity of the middle of the float chamber. For a float placed in the float chamber of such a narrow, complicated interior shape, a double float has proven useful.

The double float of prior art is generally constructed with a base having a mounting portion for swingably mounting the float in the float chamber, an arm portion connected to the base, and two float parts connected the arm portion so that they are located opposite to each other at different positions of the arm portion. Such arm portions are available in various shapes; typically, those in which the arm portion is configured into a roughly straight form, those in which it is bent at a predetermined angle from a connection of the arm portion with the base and is configured to extend roughly straight to the float parts, and those in which it is configured into a curved form.

Such a double float for carburetors must be constructed so that it can fit into and operate within in a narrow float chamber, thus requiring a high degree of dimensional accuracy. For example, in the case of an extremely small carburetor used in a motorcycle, tie carburetor must be manufactured such that the float is placed to keep the space between the float and the wall of the float chamber to about 1 mm and is operated in this state.

In recent years, on the other hand, the development of various parts made of synthetic resin has taken place. The major reasons for this are that lightweight parts can be made and parts of complicated shape can be mass-produced at low cost. Since the double floats for small-sized carburetors must also be manufactured so as to be light-weight and to accommodate the special shape inside the float chamber, most of them have come to be made of synthetic resin.

However, it is difficult for a double float requiring a high degree of dimensional accuracy to be constructed of synthetic resin. For this respect, two prior art examples having typical structures will be explained below in reference to drawings.

First, in FIG. 1, a description is given of the prior art example of a double float assembly with a straight arm. FIG. 1 shows the float mounted in the float chamber, viewed from above.

A base 1 of the float includes a mounting portion 1*a* and a control portion 1*b*. The mounting portion 1*a* is cylindrical and receives a shaft disposed in the float chamber which is rotatably fitted into a center bore 1a1 to thereby mount the float in the float chamber. In this way, the float can be swung in accordance with the internal fuel capacity of the float chamber.

The control portion 1*b* connected to the mounting portion 1*a* has the shape of a plate and is designed so that when the internal fuel capacity of the float chamber reaches a predetermined amount, the lower end of a known needle valve is pushed upward to control the supply of the fuel into the float chamber. When the amount of fuel in the float chamber is decreased, the needle valve is lowered to keep the fuel in the float chamber to the predetermined amount. Usually, in order to surely lower the needle valve, the control portion 1*b* is removably mounted to the lower end of the needle valve.

The base 1 is joined to an arm portion 2 in the vicinity of the middle in a longitudinal direction of the arm portion 2 and assumes such a shape that the arm portion 2 extends straight from both sides of the base 1. Some of the prior art double floats, however, are such that the base 1 is not joined in the vicinity of the middle of the arm portion 2 but is shifted to the right or left therefrom. The present invention is also applicable to the floats of such shape.

In FIG. 1, the arm portion 2 has the shape of a plate in which a dimension in a direction perpendicular to the plane of this figure is smaller than that in a vertical direction parallel to the plane of the figure, and the former dimension is constant. The arm portion 2 is provided with a projection 2*a* on the right hand side of the base 1. The projection 2*a* is adapted to abut a stopper of the float chamber when the amount of fuel in the float chamber is excessively decreased.

Float parts 3 and 4 are connected to both ends of the arm portion 2 and are arranged opposite to each other. As is well known, covers 3*a* and 4*a* are attached to the float parts 3 and 4 by means of adhesion or welding so that the float parts 3 and 4 are hollow. Thus, this prior art double float, with the exception of the covers 3*a* and 4*a,* is integrally molded by using a set of dies.

In FIG. 2. reference is made to the prior art example of a double float assembly in which the arm portion is curved. A base 5 of this float is provided with a cylindrical mounting portion 5*a*. The float is swingably mounted in the float chamber on a shaft that is rotatably fitted into a bore 5*a*1.

Furthermore, the base 5 is equipped with a needle valve and a control portion 5*b* for controlling the needle valve. Since a specific shape of the control portion 5*b* and the mounting of the needle valve are the same as in one of the embodiments which will be described later, their detailed explanations are omitted here.

Tile base 5 is joined to a curved arm portion 6 in the vicinity of the middle in a longitudinal direction of the arm portion 6. The arm portion 6, like the arm portion 2 shown in FIG. 1, has the shape of a plate which is constant in thickness (in a direction normal to the plane of the figure), and float parts 7 and 8 are connected opposite to each other to both ends of the arm portion 6. The float parts 7 and 8 are hollow, and their covers 7*a* and 8*a* are mounted on the front sides of the float parts 7 and 8 with respect to the figure.

The floats constructed as mentioned above, because of their structures, cannot be easily molded and fabricated. The major problem in manufacturing is that it is difficult to shape the arm portion into a predetermined form. Specifically, for the prior art example of FIG. 1, it is difficult to maintain the straightness of the arm portion 2, and in that of FIG. 2, it is also difficult to shape the arm portion 6 into a predetermined curved form. Unless the straightness and the curved form are accurate, the float parts will come in contact with the wall of the float chamber, and cannot function properly.

As is well known, the melted material of synthetic resin, when cooled, is crystallized and solidified, and in general, its shrinkage rate increases with increasing time for solidification. In the context of a float made of synthetic resin, when the melted material is injected into a metallic mold and placed under a cooling process, an internal region of the injected material cools more slowly than an external region.

Since the amount of internal shrinkage in the arm portion is thus larger than the amount of external shrinkage, the float parts are inclined inwardly as indicated by arrows in FIGS. 1 and 2, and the float fails to maintain a predetermined shape.

Thus, where the double float of this type is manufactured, special fabrication techniques, such as a temperature control in the cooling process of the metallic mold and special selection of material, have been used, and other provisions have been made for preventing the deformation of the arm portion. Consequently, fabrication costs have become high and cannot be easily reduced.

SUMMARY OF THE INVENTION

It is, therefore, a primary object of the present invention to provide a float of synthetic resin for carburetors in which the deformation of the arm portion is in a molding fabrication process and a predetermined shape is obtained with a high degree of accuracy.

Another object of the present invention is to provide a float of synthetic resin for carburetors in which the arm portion is shaped into a straight form as a whole in the molding fabrication process and manufacturing costs are low.

Still another object of the present invention is to provide a float of synthetic resin for carburetors in which the curved shape of the arm portion is surely obtained in the molding fabrication process and manufacturing costs are low.

In order to achieve the above objects, the float of synthetic resin for carburetors includes a base having a mounting portion for mounting the float in the float chamber, two float parts arranged opposite to each other and moved in accordance with the internal fuel capacity of the float chamber, and an arm portion connected to the base at a place of its longitudinal direction and connecting the float parts to its ends. The arm portion is constructed so that the sectional area of the arm portion cut in a direction perpendicular to the longitudinal direction is small in a region surrounded by the two float parts and larger on the opposite side thereof.

According to one aspect of the present invention, the arm portion is shaped into a roughly straight form.

According to another aspect of the present invention, the arm portion is bent at a predetermined angle from a connection of the arm portion with the base and is configured to extend roughly straight to the float parts.

According to another aspect of the present invention, the arm portion is bent in the region surrounded by the two float parts.

According to another aspect of the present invention, the arm portion has the shape of a planar plate so that it is curved along its plane and at least one rib curved in a nearly opposite direction of the curve of the planar plate is configured on at least one surface of the planar plate.

According to another aspect of the present invention, at least one rib of curved shape is configured between the connection of the arm portion with the base and each float part.

According to another aspect of the present invention, the arm portion is constructed with a planar plate of nearly equal thickness.

According to another aspect of the present invention, the arm portion includes a plurality of parallel arms so that the sectional area of the arm in a region surrounded by the two float parts is small and that of the arm on the opposite side thereof is larger.

According to another aspect of the present invention, the arm portion includes a plurality of parallel arms between the connection of the arm portion with the base and each float part so that the sectional area of the arm in a region surrounded by the two float parts is small and that of the arm on the opposite side thereof is larger.

According to another aspect of the present invention, ribs for connecting the plurality of parallel arms are provided between these arms.

According to another aspect of the present invention, the base is connected to one end of the arm portion, one of the two float parts is connected to the other end thereof, and the other of the two float parts is connected to the base.

These and other objects as well as the features and advantages of the present invention will become apparent from the following description of the preferred embodiments when taken in conjunction with the accompanying drawings.

DETAILED DESCRIPTION OF THE PREFERRED EMBODIMENTS

Referring to FIGS. 3 to 6, the structure of the first embodiment of the present invention is explained. The double float of this embodiment is made of synthetic resin and has the same structure as that of the prior art example shown in FIG. 1 with the exception of the arm portions. Thus, the description of identical constituent parts is simply given.

A base 9 includes a mounting portion 9*a* and a control portion 9*b*. The mounting portion 9*a* is provided with a bore 9*a*1 into which the shaft provided in the float chamber is rotatably fitted. The control portion 9*b* assumes the shape of a plate and is adapted to control the position of a known needle valve in accordance with the amount of fuel in the fuel chamber. Although some of the floats are such that the control portion 9*b* is made of metal, such as aluminum or brass, which is welded to part of the base 9 and the arm portion, the control portion 9*b* in the present invention can have any structure.

The base 9 is joined to an arm portion 10 in the vicinity of the middle in a longitudinal direction of the arm portion 10. The arm portion 10 is in general shaped nearly straight and has two arms 10*a* and 10*b* placed practically parallel to each other. In the first embodiment, each of the arms 10*a* and 10*b* assumes such a shape that it is cut at its middle, and it appears as if such cut arms extend separately from the connection of the arm portion 10 with the base 9 to both sides thereof. The arms 10*a* and 10*b* are equal in thickness (dimension in a direction normal to the plane of FIG. 3). In this way, the arm portion 10 is designed so that the sectional area of the arm l0*a* cut normal to the longitudinal direction of the arm portion 10 is smaller than that of the arm 10*b*.

In the first embodiment, the arm 10*b* extending to the right hand side of the base 9 is provided with a projection 10*b*1. The projection 10*b*1 is adapted to abut a stopper provided on the wall of the float chamber when the amount of fuel in the float chamber is excessively decreased. The projection 10*b*1 need not necessarily be provided on the arm portion 10, and may be configured on the mounting portion 9*a*.

Float parts 11 and 12 are connected to both ends of the arm portion 10 and are arranged opposite to each other. Covers 11*a* and 12*a* are attached to the float parts 11 and 12, respectively, whose interiors are empty. Although in the first embodiment the float parts 11 and 12 are arranged symmetrically, this arrangement needs to accommodate the shape or the float chamber and thus is not actually symmetrical in most cases.

Figure 1:
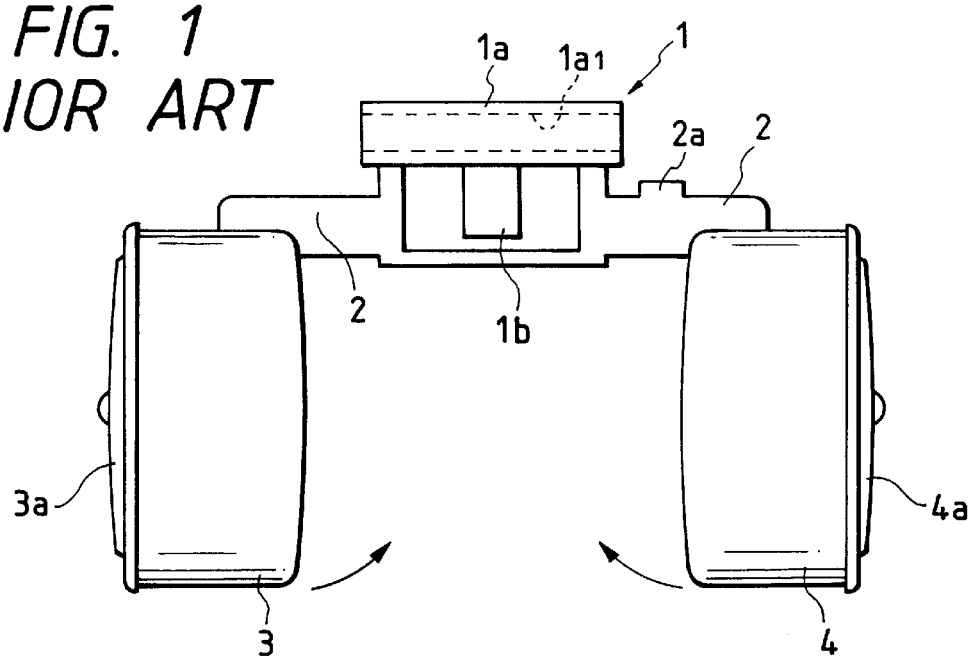
FIG. 1 PRIOR ART
FIG. 1 is a plan view showing one conventional float for carburetors.

In the first embodiment constructed as mentioned above, it is avoidable that the float parts are inclined as indicated by arrows in FIG. 1. The melted material of synthetic resin, as already stated, is such that, in general, the amount of shrinkage increases with increasing time for solidification. Hence, for elongated parts and members, as a volume per unit length is made large, the time required for solidification becomes longer and the amount of shrinkage increases. In the first embodiment, if the arms 10*a* and 10*b* are equal in length and volume and are solidified in the same ambient, the arms will have the same amount of shrinkage and the arm portion will not be deformed.

Since, however, the internal region of a metallic mold surrounded by the arm portion 10 and the float parts 11 and 12, compared with the external region thereof, is high in temperature and requires much time for temperature drop, the time for solidification of the inside arm 10*a* is longer than that of the outside arm 10*b*. Thus, with the arms 10*a* and 10*b* having the same length and sectional shape, as in the prior art example of FIG. 1, the arm portion 10 will be deformed and the float parts 11 and 12 will be inclined inwardly.

In order to meet such a case, it is only necessary that the volumes of the outside and inside arms, namely the sectional areas, are made to differ from each other so that both are about equal in the amount of shrinkage. In the case of the first embodiment, the inside arm 10*a* is not equal in length to the outside arm 10*b*, but in view of the above description, the sectional area of the arm 10*a* is made smaller than that of the arm 10*b* so that both are about equal in the amount of shrinkage. By doing so, it becomes possible that the double float with predetermined dimensional tolerances is fabricated at low cost.

Figure 7:
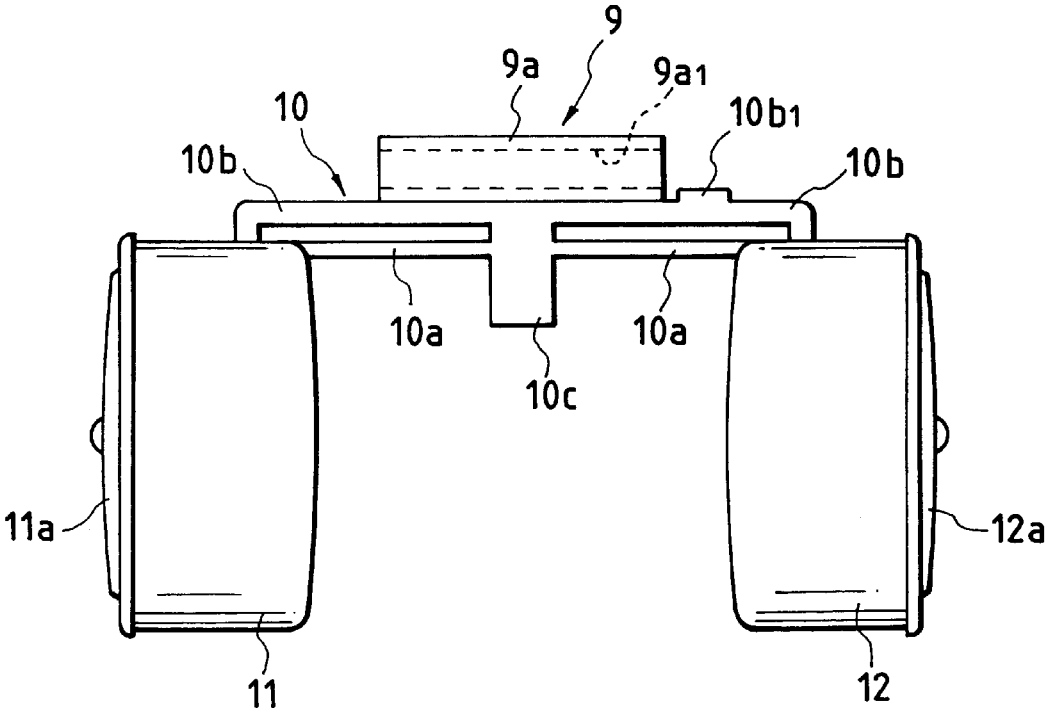
FIG. 7 is a plan view showing a second embodiment of the float for carburetors according to the present invention.

A, a description is given of the structure of the second embodiment in reference to FIG. 7. This embodiment merely modifies a part of the first embodiment, and like references are used for substantially like parts. Thus, only parts different in shape are explained. The base 9 of the second embodiment is substantially constructed with only the mounting portion 9*a*, and the arms 10*a* and 10*b* are connected to each other in the vicinity of the connection of the mounting portion 9*a*. A control portion 10*c* extends from the vicinity of the middle of the arm 10*a* toward the lower side of the figure. The shape and function of the control portion 10*c* are the same as those of the control portion 10*c* of the first embodiment.

The second embodiment, although it is constructed as described above, is the same as the first embodiment in that the arm 10*a* is different in sectional area from the arm 10*b*, and thus, as in the first embodiment, the double float with predetermined dimensional tolerances can be fabricated at low cost.

Figure 8:
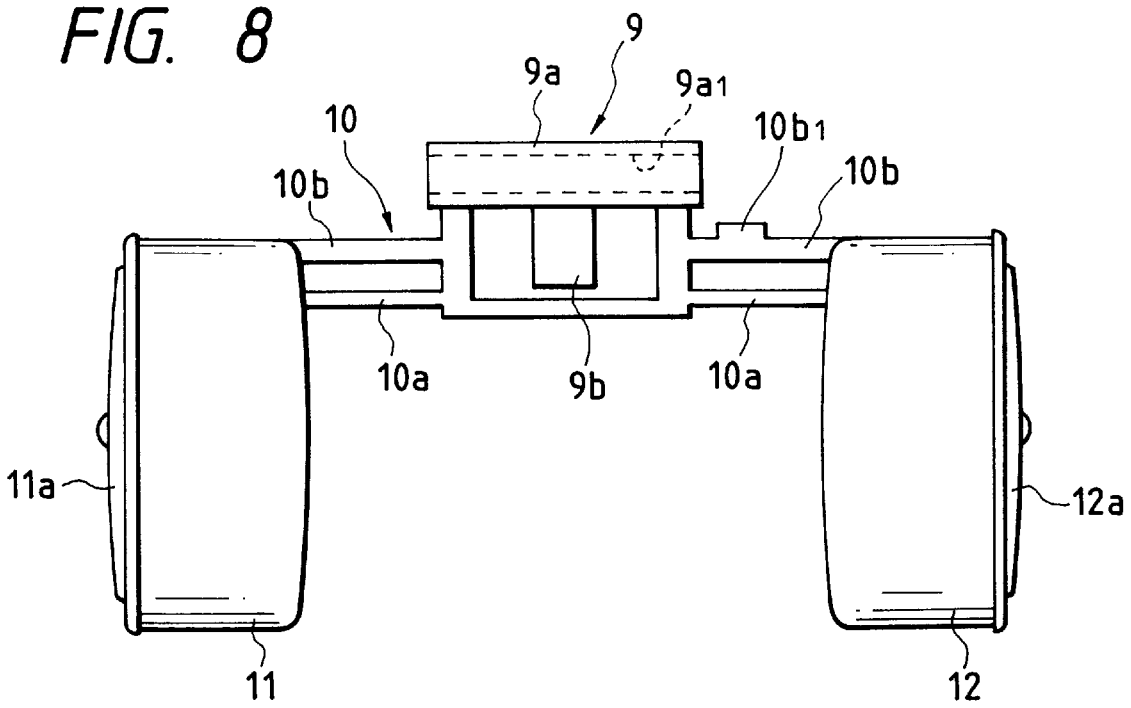
FIG. 8 is a plan view showing a third embodiment of the float for carburetors according to the present invention.

Using FIG. 8, reference is made to the structure of the third embodiment. This embodiment also merely modified a part of the first embodiment, and like references are used for substantially like parts. Thus, only parts different in shape are explained. In the first embodiment, the outside arm 10*b* is bent at an angle of about 90° to join the float parts 11 and 12, but in the third embodiment, the outside arm 10*b* is connected to the float 11 and 12 as in the inside arm 10*a*, without bending at right angles. Thus the arms 10*a* and 10*b* have almost the same length.

The third embodiment, although it is constructed as described above, is the same as the first embodiment in that the arm 10*a* is different in sectional area from the arm 10*b*, and thus, as in the first embodiment, the double float with predetermined dimensional tolerances can be fabricated at low cost.

In the third embodiment, the arm l0*a* is configured so that even though it is cut at any place, the sectional shape is much the same. The arm 10*b* is also configured so that even though it is cut at any place, the sectional shape is much the same with exception of the projection 10*b*1. However, if the amount of shrinkage of the arm 10*a* can be made equal to that of the arm 10*b*, the uniformity in the sectional shape of the arms will not be necessary. The uniformity of the sectional area is also not necessary. The same holds for the cases of the above embodiments.

Figure 9:
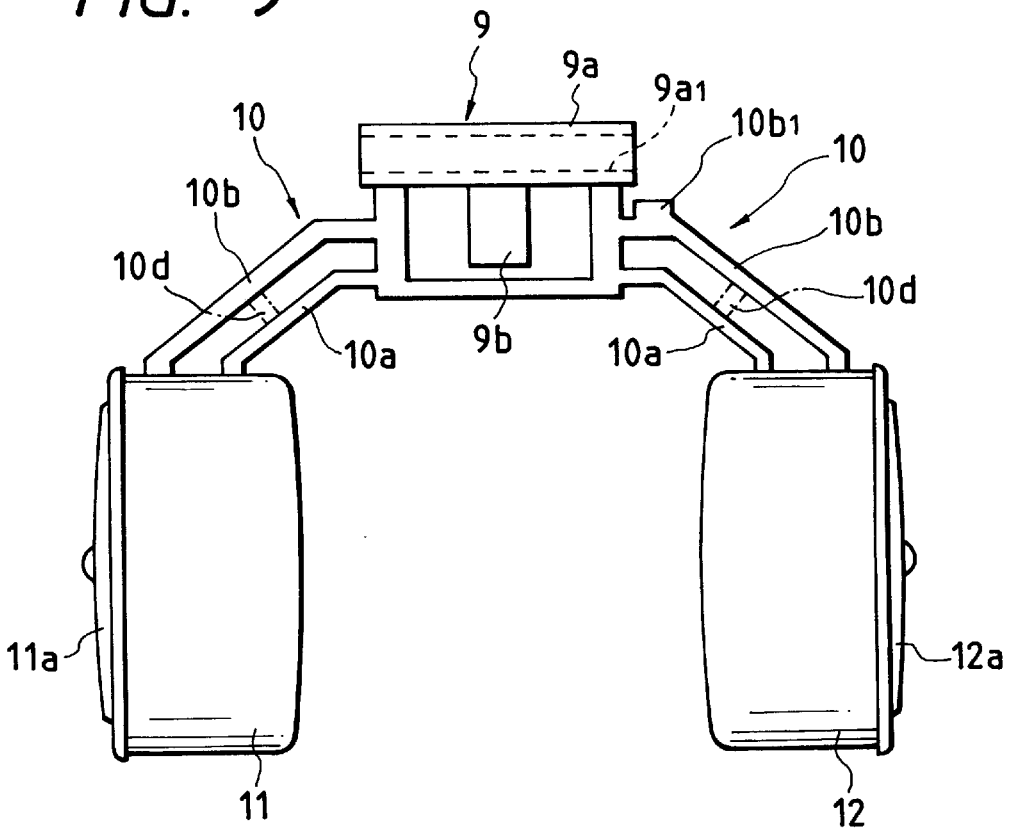
FIG. 9 is a plan view showing a fourth embodiment of the float for carburetors according to the present invention.

Referring to FIG. 9, the structure of the fourth embodiment is explained. This embodiment also merely modifies a part of the first embodiment, and like references are used for substantially like parts. In the first embodiment, the arm portion 10 is placed nearly straight, but in the fourth embodiment, the arm portion 10 is bent at a predetermined angle in the vicinity of the connection with the base 9 and is shaped to extend roughly straight therefrom. Even in doing so, the float parts 11 and 12 are arranged to make at right angles with the longitudinal direction of the bore 9*a*1.

The fourth embodiment, although it is constructed as described above, is the same as the first embodiment in that the arm 10*a* is different in sectional area from the arm 10*b*, and thus, as in the first embodiment, the double float with predetermined dimensional tolerances can be fabricated at low cost.

In the fourth embodiment, the arm portion 10 is chiefly constructed with the two arms 10*a* and 10*b* parallel to each other, but it may include three or more arms. In the case where the lengths of the arms are too long, when one or more ribs 10*d*, as indicated by chain lines in FIG. 9, are provided between the arms 10*a* and 10*b*, the shape accuracy of the arm portion 10 is attained.

Figure 10:
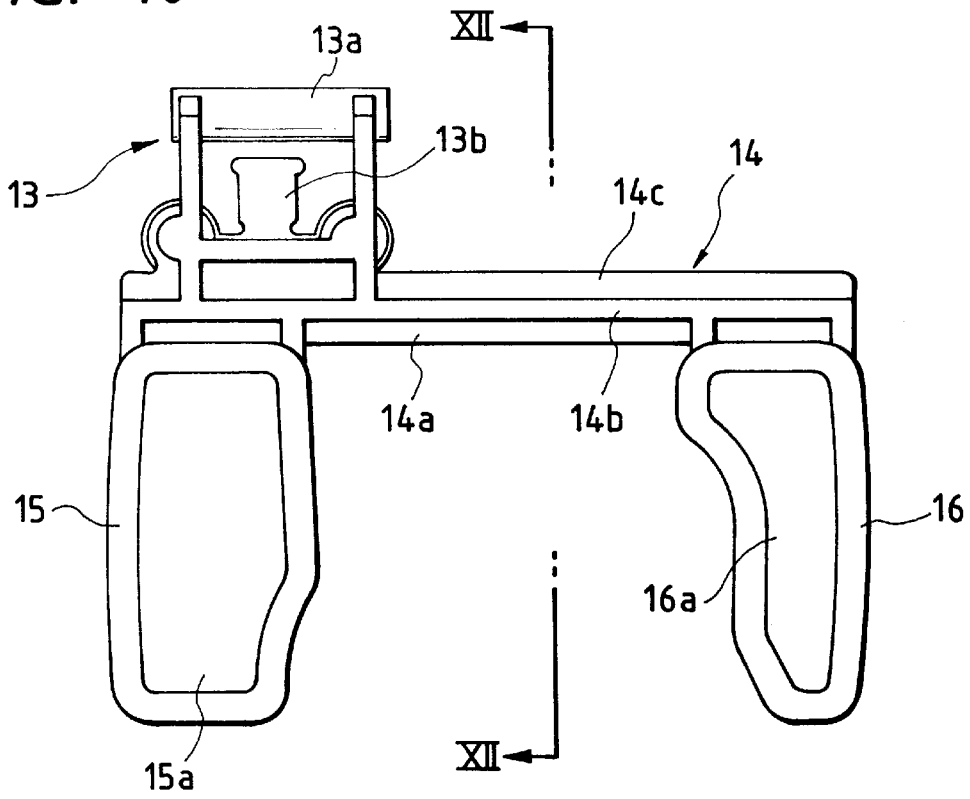
FIG. 10 is a plan view showing a fifth embodiment of the float for carburetors according to the present invention.
Figure 11:
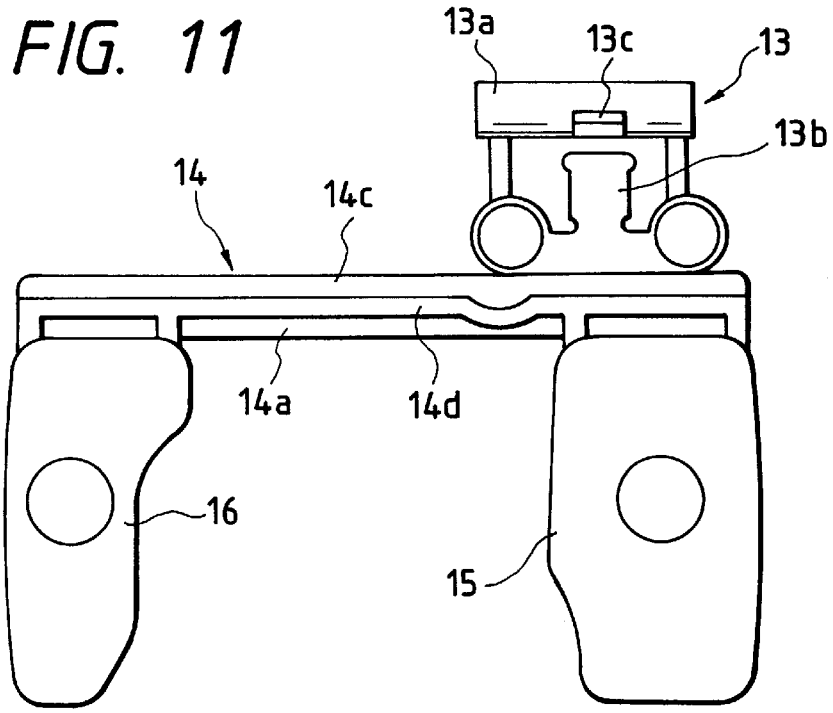
FIG. 11 is a rear view of FIG. 10.
Figure 12:
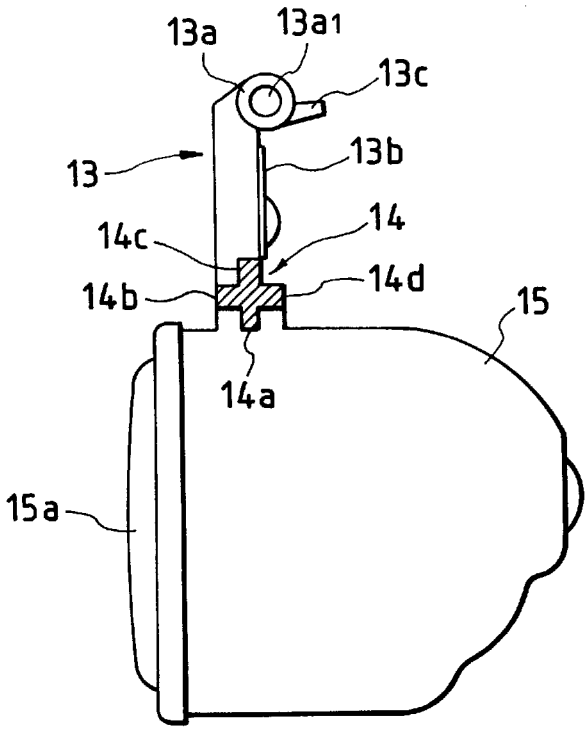
FIG. 12 is a sectional view taken on line XII—XII in FIG. 10.
Figure 13A:
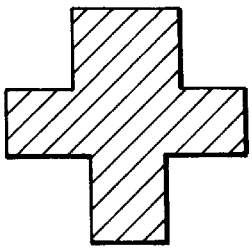
FIGS. 13(*a*), 13(*b*), 13(*c*), 13(*d*), 13(*e*), and 13(*f*) are sectional views showing modification examples of the section of the arm portion shown in FIG. 12.
Figure 13B:
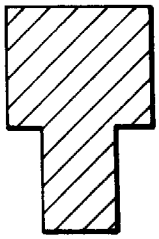
Figure 13C:
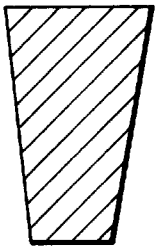
Figure 13D:
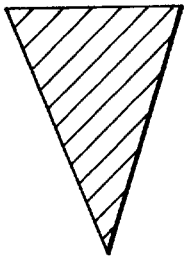
Figure 13E:
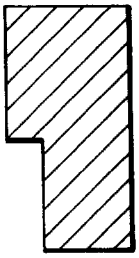
Figure 13F:
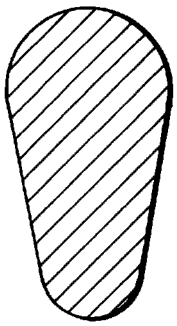

Next, using FIGS. 10 to 12, the fifth embodiment is described. Basically, as in the above embodiments, this embodiment is also constructed with the base, the arm portion, and two float parts. A base 13 of the fifth embodiment is provided with a mounting portion 13*a*, in which as shown in FIG. 12, a bore 13*a*1 is made into which the shaft provided in the float chamber is rotatably fitted.

A control portion 13*b* for controlling the vertical movement of the needle valve is made of nonferrous metal as another material and is welded at two places. As seen from FIGS. 11 and 12, the base 13 is provided with a projection 13*c*, which is adapted to perform the same function as the projection 10*b*1 configured on the arm portion 10 in the above embodiments.

In the fifth embodiment, an arm portion 14 of straight shape is connected to the base 13 in the vicinity of its one end. In other words, the arm portion 14 extends straight along one direction from the base 13. Float parts 15 and 16 are connected to the ends of the arm portion 14. Covers 15*a* and 16*a* are attached to the float parts 15 and 16, respectively, which are hollow. The float parts 15 and 16, which need to accommodate the shape of the float chamber, are different in shape from each other.

The arm portion 14, as seen from FIG. 12, has a cross-shaped section and is constructed with four plates 14*a*, 14*b*, 14*c*, and 14*d*. The plate 14*a* is configured with less thickness than each of the other plates 14*b*, 14*c*, and 14*d*.

The fifth embodiment, unlike the above embodiments, is such that since the base 13 is joined to the arm portion 14 in the vicinity of one end of the arm portion 14, the length of the arm portion 14 extending from the base 13 is relatively long. Thus, it may be said that the arm portion 14 is liable to deformation, compared with the above embodiments. According to the fifth embodiment, however, the deformation of the arm portion 14 is prevented.

The melted material of synthetic resin, as already stated, is such that, in general, the amount of shrinkage increases with increasing time for solidification. Hence, for the members and parts of plate shape, as the thickness of the plate increases, a volume per unit length becomes larger and the time required for solidification becomes longer, thus increasing the amount of shrinkage.

Thus, in the fifth embodiment, the inside plate 14*a* requiring much time for temperature drop is made smaller in thickness than the outside plate 14*c*, and thereby both are made identical in the amount of shrinkage to obviate the deformation of the arm portion 14. Hence, even in the fifth embodiment, the double float with predetermined dimensional tolerances can be fabricated at low cost.

As may be understood from the above description, it is considered that the arm portion 14 is made to have various sectional shapes in addition to that shown in FIG. 12. In short, it is only necessary that the arm portion 14 is designed so that the sectional area of an outward part becomes large compared with that of an inward part surrounded by the float parts 15 and 16. Thus, the modification examples of various sectional shapes easy to make as in the sectional shape of the arm portion 14 of the fifth embodiment are shown in FIGS. 13(*a*) to 13(*f*).

Figure 14:
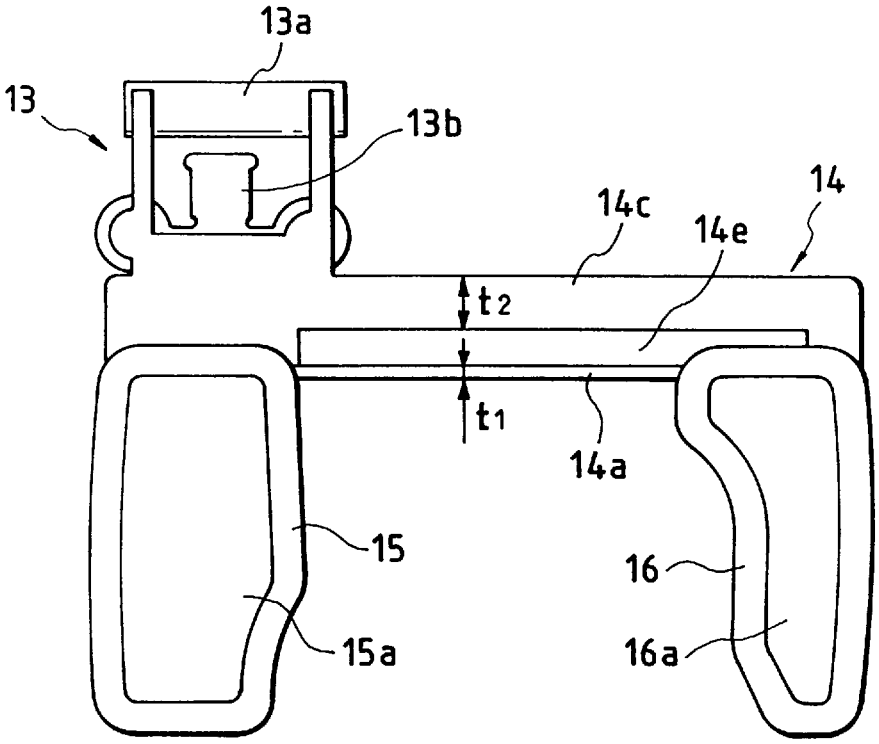
FIG. 14 is a plan view showing a sixth embodiment of the float for carburetors according to the present invention.

In accordance with FIG. 14, the structure of the sixth embodiment is explained. This embodiment is such that the plates 14*b* and 14*d* of the fifth embodiment are removed to afford a space 14*e*. Here, the relation between a vertical dimension $t_1$ of the plate 14*a* and a vertical dimension $t_2$ of the plate 14*c* is defined as $t_1<t_2$. Since other constituents are substantially the same as in the fifth embodiment, the reference numerals of the fifth embodiment are used.

In general, when the sectional shape of the arm portion 14 is large and a dimension from the center to the surface of the section increases, there is a large difference in time required for solidification between the vicinities of the center and the surface. Moreover, it is comparatively difficult to fabricate the arm portion so that the time required for solidification becomes equal with respect to sections. Hence, when the dimension from the center to the surface is large, the arm portion 14 may be deformed and distorted if it is long.

In the sixth embodiment, however, the space 14*e* is provided between the plates 14*a* and 14*c*, and thus there is little difference in time for solidification between the center and the surface of the section, compared with the fifth embodiment. Furthermore, the float part 16 is not inclined inwardly because the plate 14*a* is smaller in sectional area than the plate 14*c* as in the fifth embodiment.

Additionally, in the sixth embodiment, the plate 14*a* is different in thickness from the plate 14*c* as in the fifth embodiment, and even if $t_1=t_2$, the same effect can be brought about. When $t_1<t_2$, the same effect can be secured without the difference of the thickness.

Figure 15:
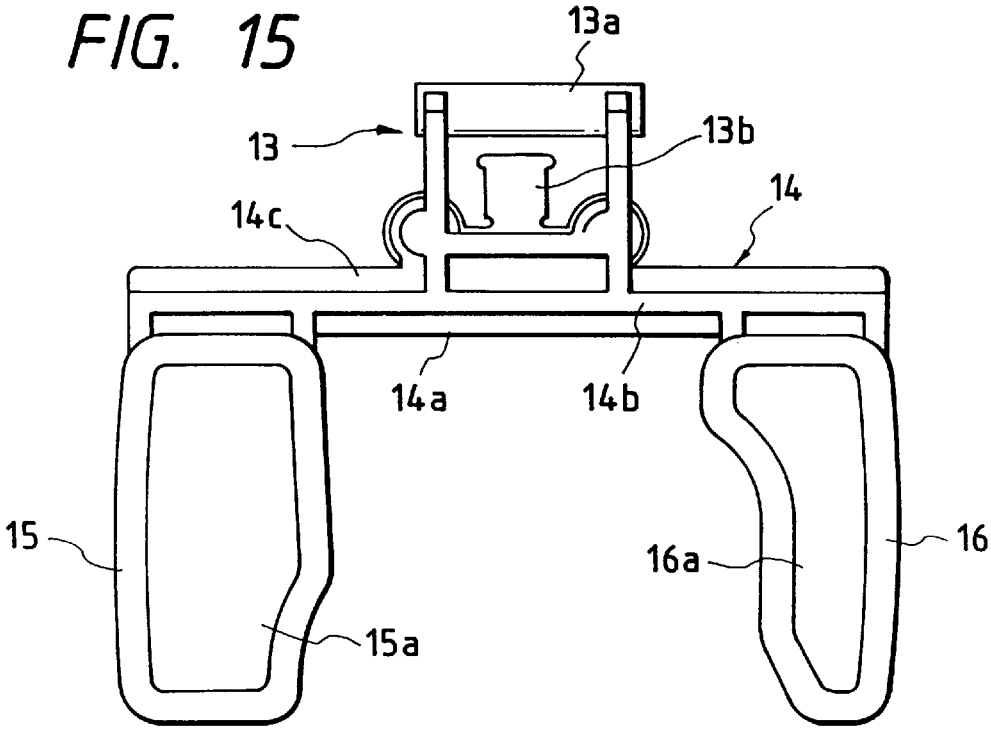
FIG. 15 is a plan view showing a seventh embodiment of the float for carburetors according to the present invention.

FIG. 15 shows the seventh embodiment. This embodiment is designed so that the base 13 and the arm portion 14 of the fifth embodiment are joined about the middle of the arm portion 14. In other words, it is similar in appearance to the case of the first embodiment. Even with such a structure, for the already-mentioned reasons, the double float with predetermined dimensional tolerances can be fabricated at low cost as in the above embodiments.

Figure 16:
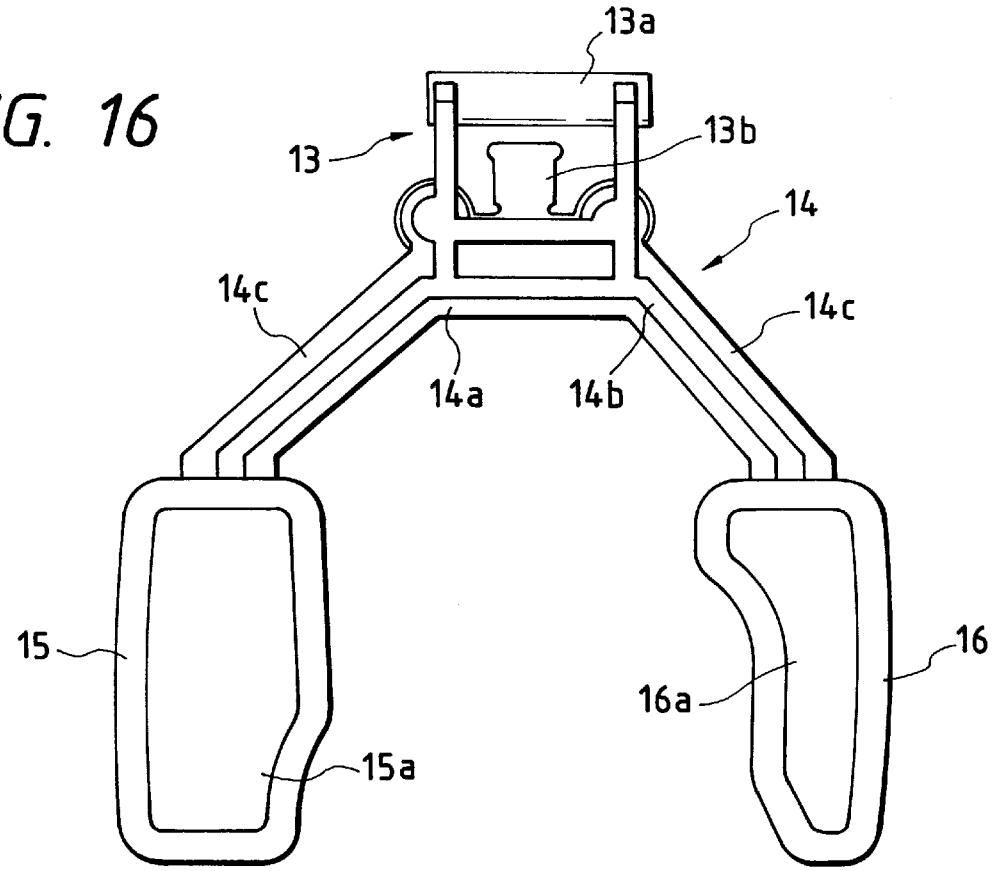
FIG. 16 is a plan view showing an eighth embodiment of the float for carburetors according to the present invention.

FIG. 16 shows the eighth embodiment. This embodiment is a modified example of the seventh embodiment, and like numerals are used for substantially like parts. Although in the seventh embodiment the arm portion 14 is placed parallel to the mounting portion 13*a* of cylindrical shape, the arm portion 14 in the eighth embodiment is bent at a predetermined angle from the connection with the base 13 and extends nearly straight to the float parts 15 and 16. Even with such a structure, the float parts 15 and 16 are arranged at right angles with the longitudinal direction of the mounting portion 13*a*. In this way, the appearance of the eighth embodiment is similar to that of the fourth embodiment.

In the eighth embodiment constructed as in the foregoing, the sectional shape of the arm portion 14 is identical with the case of the seventh embodiment, and hence the double float with predetermined dimensional tolerances can be fabricated at low cost.

Figure 17:
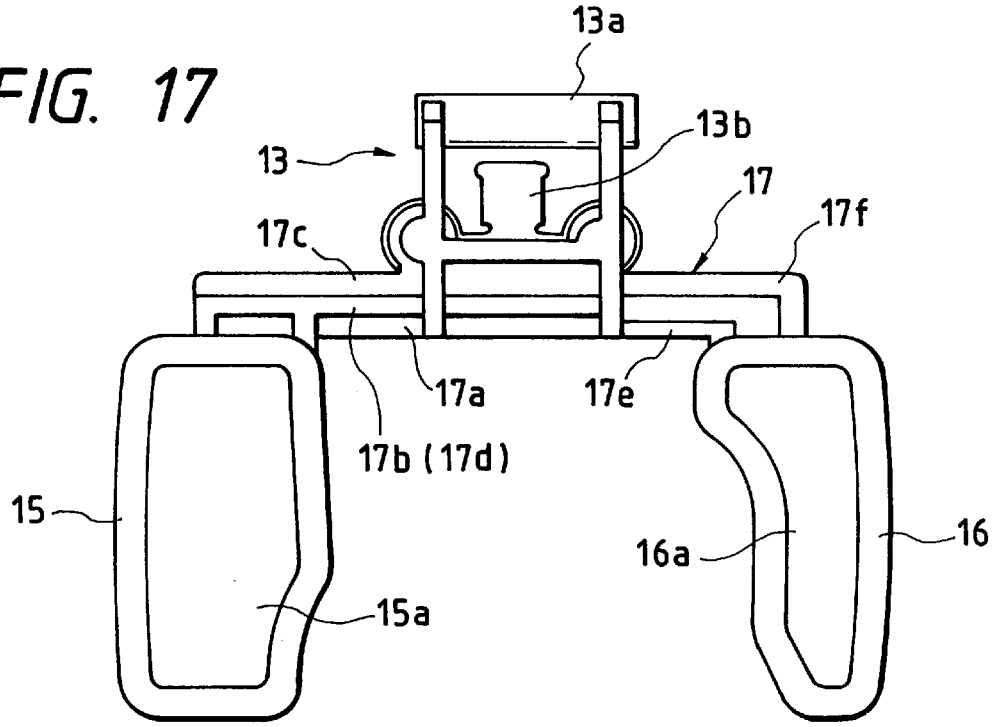
FIG. 17 is a plan view showing a ninth embodiment of the float for carburetors according to the present invention.
Figure 18:
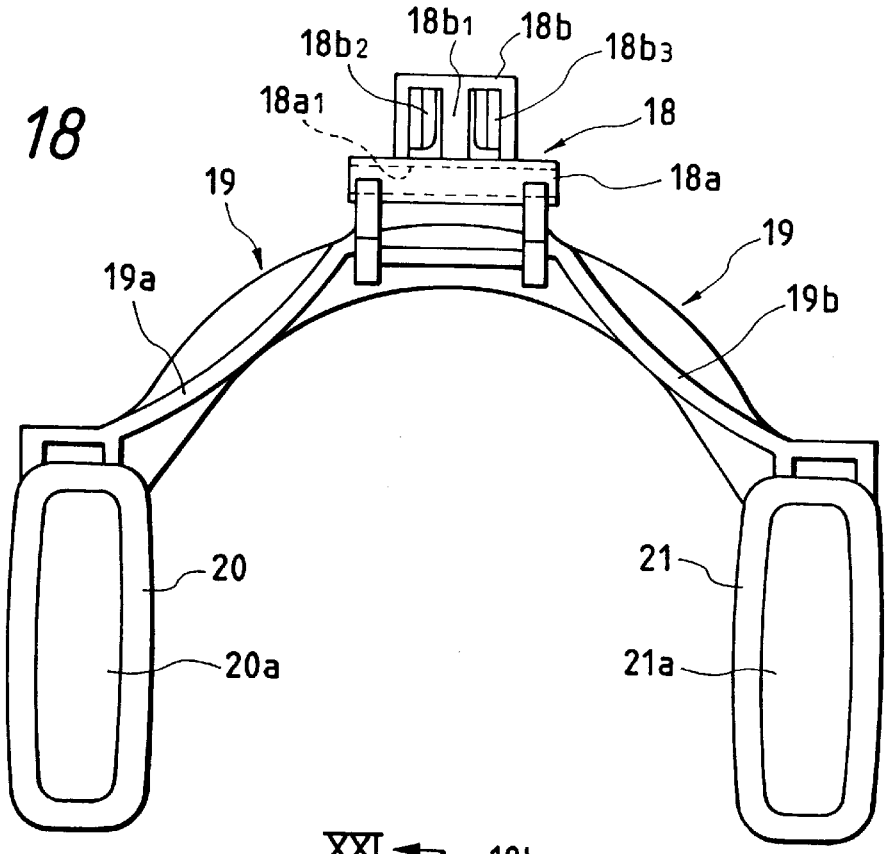
FIG. 18 is a plan view showing a tenth embodiment of the float for carburetors according to the present invention.
Figure 19:
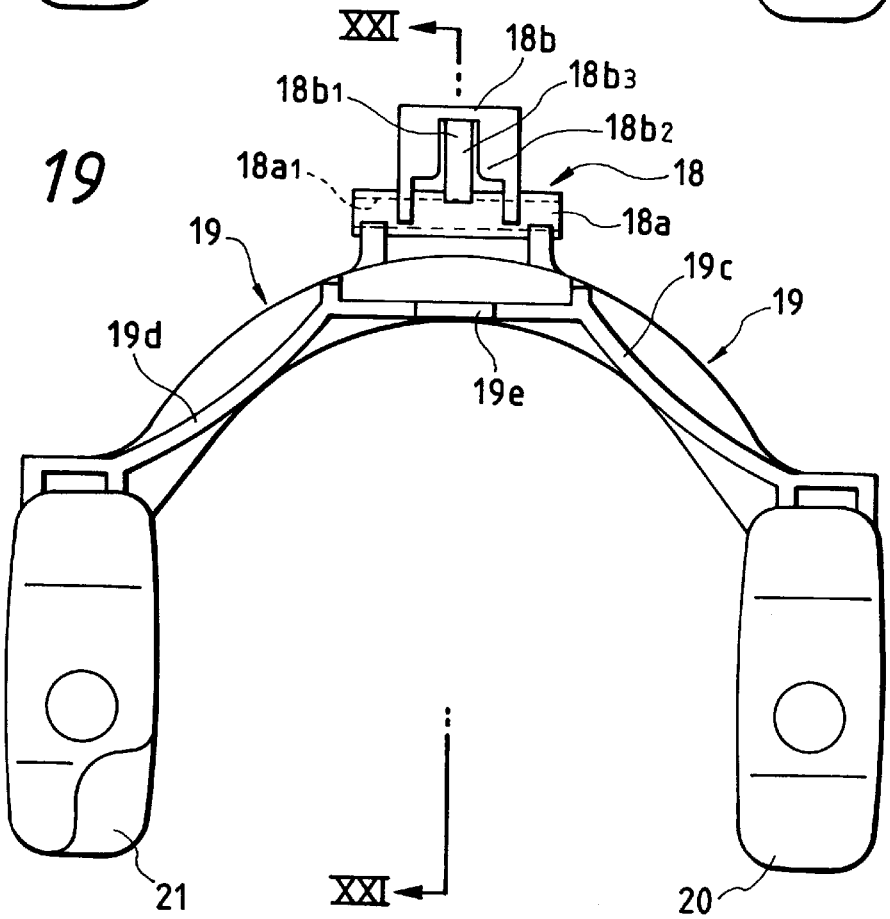
FIG. 19 is a rear view of FIG. 18.
Figure 20:
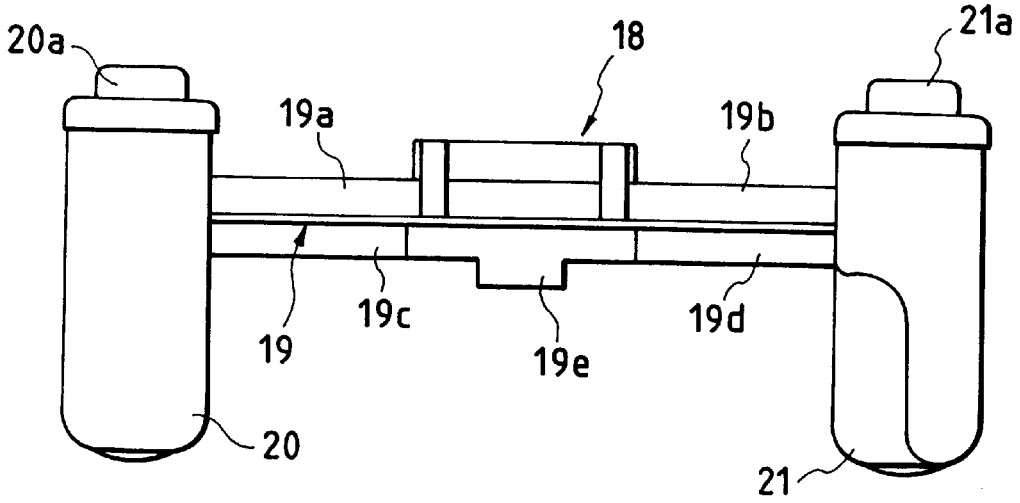
FIG. 20 is a bottom view of FIG. 18.

FIG. 17 illustrates the ninth embodiment. An arm portion 17 of this embodiment is such that the shape of the arm portion extending from the connection with the base 13 to the right is different from that of the seventh embodiment. Thus, the arm portion 17 on the left hand side of the connection with the base 13 has a cross-shaped section and is made up of four plates 17*a,* 17*b,* 17*c,* and 17*d.* The plate 17*a* is configured with less thickness than each of the other plates 17*b,* 17*c,* and 17*d.*

On the other hand, the arm portion 17 on the right hand side of the connection with the base 13 is similar in shape to the arm portion 10 of the first to third embodiments, and includes two arms 17*e* and 17*f* arranged nearly parallel to each other. The arm 17*e* is configured to have a smaller sectional area than the arm 17*f.*

Even with such a structure of the ninth embodiment, the double float with predetermined dimensional tolerances can be fabricated at low cost. Moreover, as seen from this, even though the arm portion, of the eighth embodiment, extending from the base 13 to the right is constructed with two arms such as those of the ninth embodiment, the same effect can be secured.

Finally, the tenth embodiment is explained in reference to FIGS. 18 to 21. A base 18 of this embodiment includes a mounting portion 18*a* and a control portion 18*b*. The mounting portion 18*a* is provided with a bore 18*a*1 into which the shaft provided in the float chamber is rotatably fitted.

Figure 21:
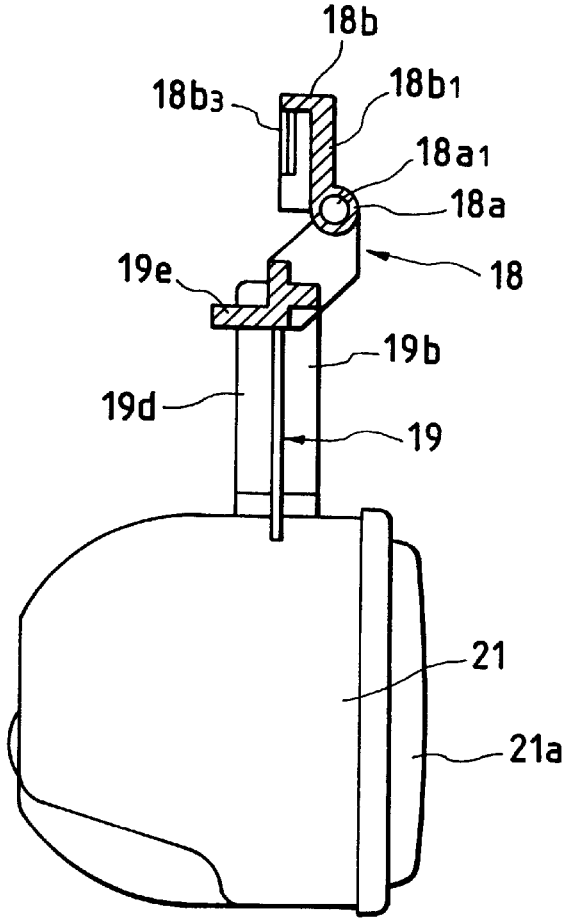
FIG. 21 is a sectional view taken on line XXI—XXI in FIG. 19.

The control portion 18*b* of the tenth embodiment has a wall 18*b*1 at its middle and is configured with two hold-down pieces 18*b*2 and 18*b*3. In FIG. 21, the needle valve is mounted in such a way that its part is inserted from below between the wall 18*b*1 and the hold-down piece 18*b*3.

An arm portion 19 of the tenth embodiment assumes the shape of a plate and is curved along its surface so that float parts 20 and 21 having covers 20*a* and 21*a* are connected to both ends of the arm portion 19.

Curved ribs 19*a,* 19*b,* 19*c,* and 19*d* are provided perpendicular to both surfaces of the arm portion 19. As seen from FIGS. 18 and 19, each of the curved ribs is configured so that its radius of curvature is the same as that of the flat plate of the arm portion 19, but the direction of the curve is reversed. Furthermore, in FIG. 18, the arm portion 19 is such that its thickness is small on the lower side of each of the ribs 19*a* and 19*b* and larger on the upper side. A projection 19*e,* provided in the vicinity of the connection of the arm portion 19 with the base 18, has the same function as in the above embodiments.

Figure 2:
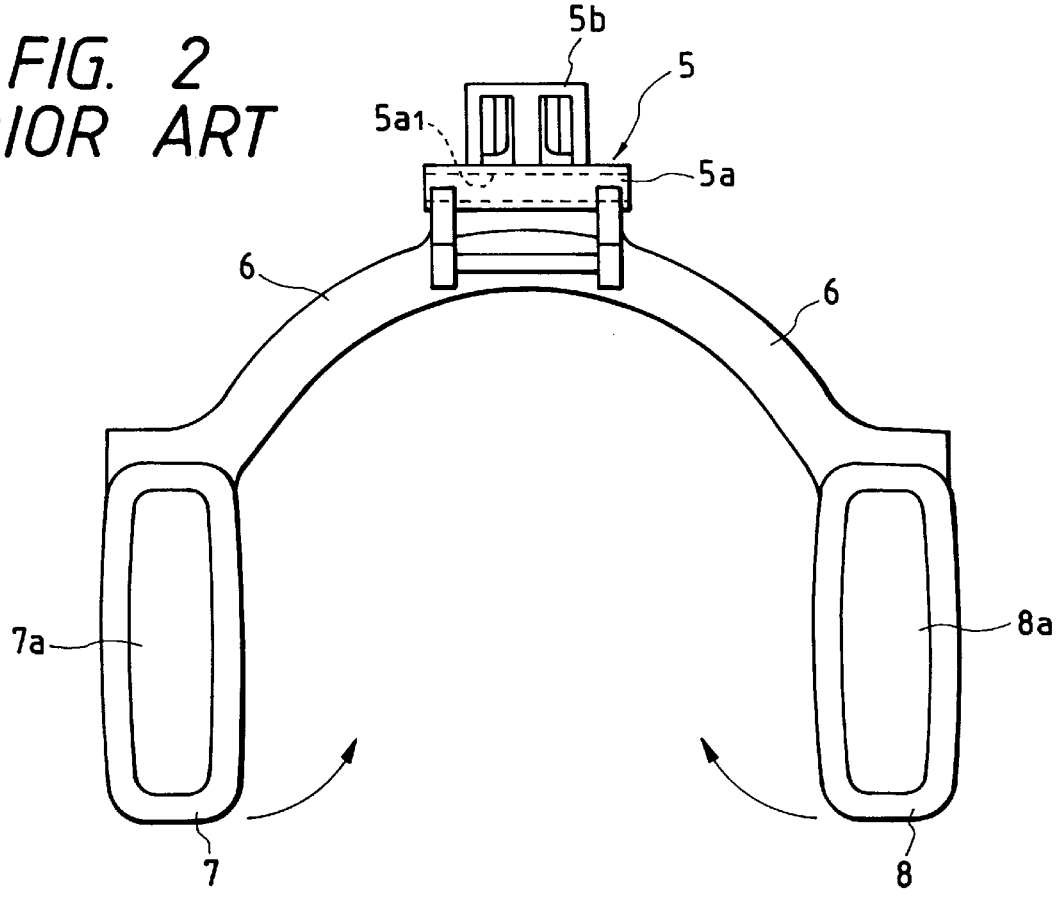
FIG. 2 PRIOR ART
FIG. 2 is a plan view showing another conventional float for carburetors.
Figure 3:
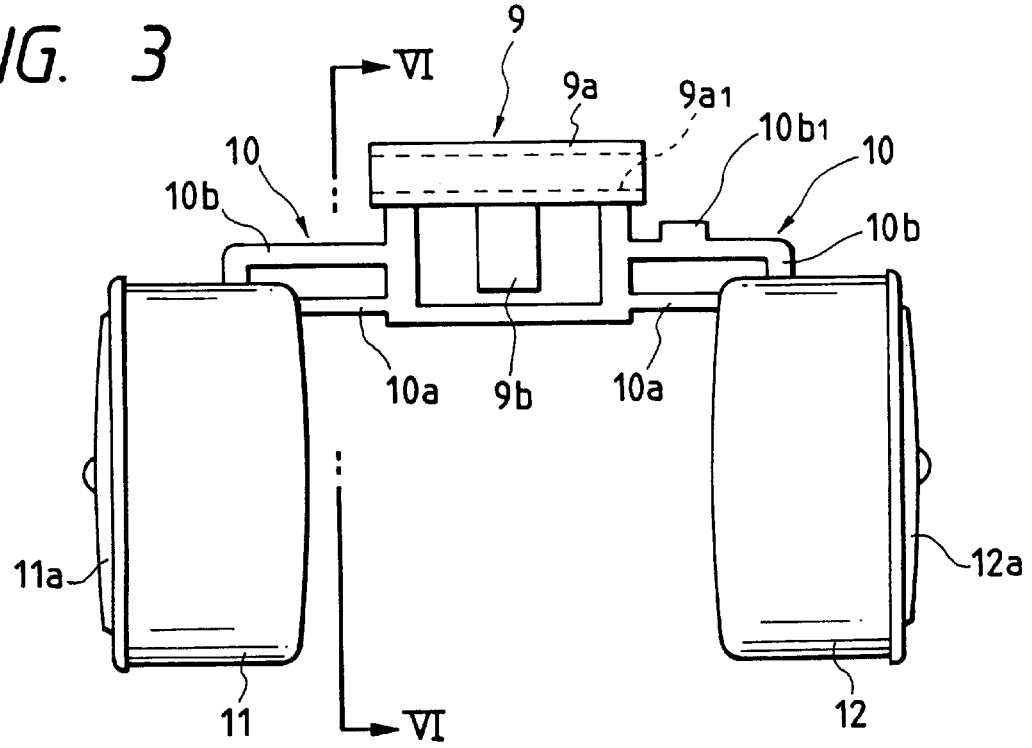
FIG. 3 is a plan view showing a first embodiment of the float for carburetors according to the present invention.
Figure 4:
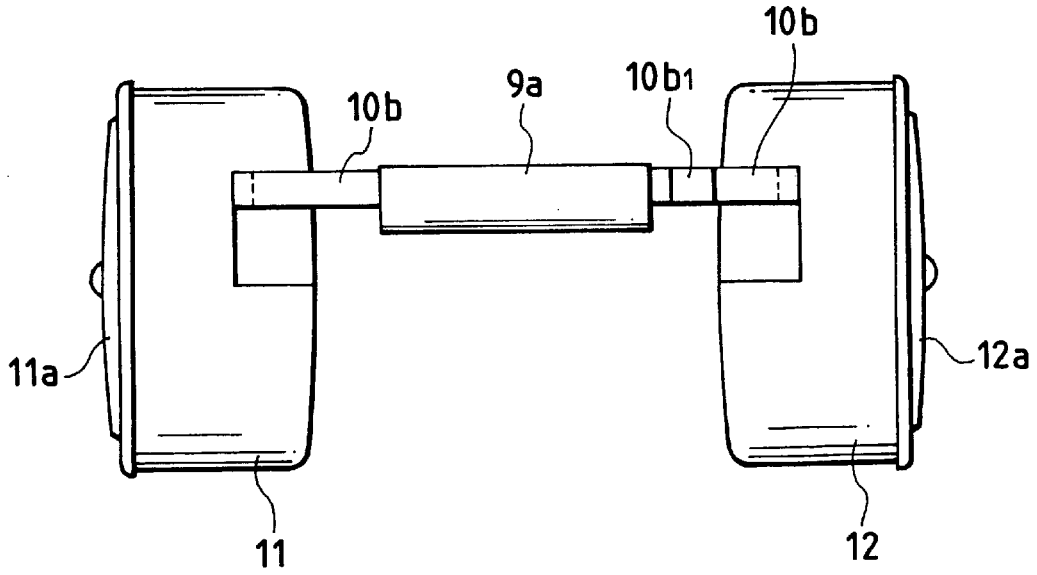
FIG. 4 is a rear view of FIG. 3.
Figure 5:
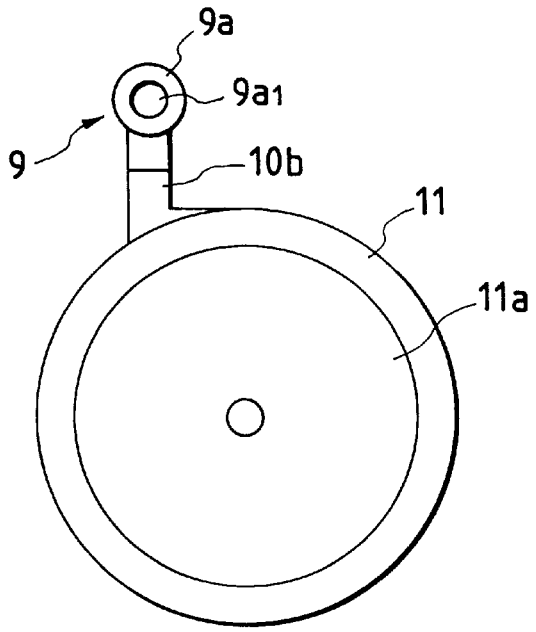
FIG. 5 is a side view of FIG. 3.
Figure 6:
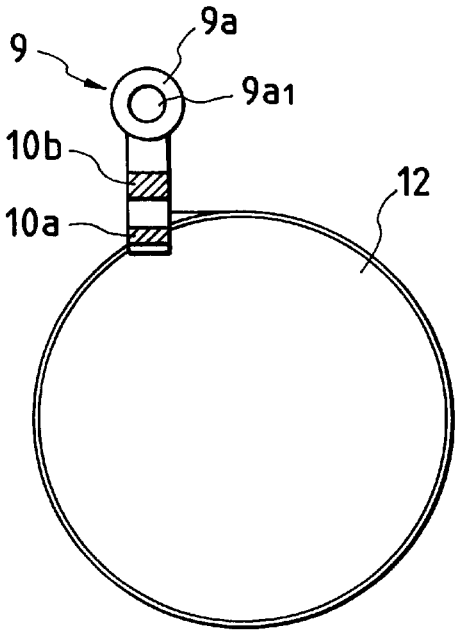
FIG. 6 is a sectional view taken on line VI—VI in FIG. 3.

Since the tenth embodiment is designed as stated above, the arm portion 19 can be fabricated in a predetermined shape, and it is avoidable that the float parts 20 and 21 are inclined as indicated by arrows in FIG. 2. Specifically, in the tenth embodiment, the arm portion 19 has the flat plate of small thickness on the lower side of each of the ribs 19*a,* 19*b,* 19*c,* and 19*d* (namely, on the side of each of the float parts 20 and 21), and thus, for the reasons explained above, the arm portion 19 is hard to bend inwardly.

In this way, the deformation of the arm portion 19 can be prevented even by properly adjusting the difference in thickness of the flat plate. Even though the deformation is not obviated by doing so, it is possible that the tenth embodiment completely prevents the arm portion 19 from deforming in such a way that, at the stage of the solidification of the melted material of synthetic resin, the action of reducing the radius of curvature is exerted on the ribs 19*a,* 19*b,* 19*c,* and 19*d* and thus resists the deformation of the flat plate.

Hence, when the ribs 19*a,* 19*b,* 19*c,* and 19*d* are even provided as in the tenth embodiment, the arm portion 19 can be prevented from bending inwardly even though the flat plate of the arm portion 19 is not configured to have different thicknesses on the upper and lower sides of the ribs.

Such curved ribs may be provided only on one surface of the arm portion 19. The radius of curvature of each rib need not be forced to equalize that of the flat plate of the arm portion 19. Further, there is no limit to the number of ribs provided on one surface of the arm portion 19. In short, it is merely necessary that a variety of curved ribs are configured by numbers required so that they are arranged opposite to the direction of the curve of the flat plate.

Even when the arm portion is curved as in the tenth embodiment, it is possible that the arm portion, like the first embodiment, is constructed with a plurality of arms having different sectional areas. In this case also, the same effect is brought about.

Further, in the tenth embodiment, the base 18 is joined to the arm portion 19 in the vicinity of the middle of the arm portion 19 in its longitudinal direction, but even when it is joined at the position close to one end of the arm portion 19 as in the fifth embodiment, the same effect is secured. Still further, although in the tenth embodiment the float parts 20 and 21 are connected to the ends of the arm portion 19, the float may be constructed so that the float part 20 is connected directly to the base 18 and one end of the arm portion 19 is connected to only the base 18. Such structures are applicable to any of the above embodiments.

What is claimed is:

1. A float of synthetic resin for a carburetor having a float chamber, comprising:

a base having a mounting portion for mounting said float in the float chamber;

an arm portion connected to said base at a location along a longitudinal extent of said arm portion; and two float parts arranged opposite to each other and movable in accordance with an amount of fuel in the float chamber, said float parts being attached to opposite ends of said arm portion proximate one side of each of said float parts so that a substantial extent of each of said float parts extends generally toward one side of said arm portion;

said arm portion being configured so that a cross-section thereof that is perpendicular to the longitudinal direction has a first region on said one side of said arm portion and a second region on an opposite side of said arm portion, wherein the area of said second region is larger than the area of said first region.

2. A float of synthetic resin according to claim 1, wherein said arm portion extends substantially straight along its longitudinal extent.

3. A float of synthetic resin according to claim 1, wherein said arm portion is bent at a predetermined angle from a connection of said arm portion with said base and is configured to extend substantially straight to said two floating parts.

4. A float of synthetic resin according to claim 1, wherein said arm portion is curved to be concave toward said one side of said arm portion.

5. A float synthetic resin according to claim 4, wherein said arm portion has a shape of a flat plate and is curved within a plane of the flat plate, and includes at least one rib, which is curved in a direction opposite to a direction of a curve of said arm portion and which is arranged on at least one surface of the flat plate.

6. A float of synthetic resin according to claim 5, wherein said at least one rib is configured between a connection of said arm portion with said base and each of said float parts.

7. A float of synthetic resin according to claim 5 or 6, wherein said flat plate has a substantially constant thickness.

8. A float of synthetic resin according to any one of claims 1–4, wherein said arm portion includes a plurality of arms arranged parallel to one another and configured so that a transverse sectional area of an arm on said one side of said arm portion is smaller than a transverse sectional area of an arm on the opposite side of said arm portion.

9. A float of synthetic resin according to claim 8, wherein said plurality of arms includes ribs for joining the arms.

10. A float of synthetic resin according to any one of claims 1–4, wherein said arm portion includes a plurality of arms arranged parallel to one another between a connection of said arm portion with said base and each of said float parts and configured so that a transverse sectional area of an arm on said one side of said arm portion is smaller than a transverse sectional area of an arm on an opposite side of said arm portion.

11. A float of synthetic resin according to claim 10, wherein said plurality of arms includes ribs for joining the arms.

12. A float of synthetic resin according to any one of claims 1–4, wherein said base is connected to one end of said arm portion, one of said two float parts is connected to a remaining end of said arm portion, and a remaining float part is connected to said base.

* * * * *